United States Patent [19]

Sayovitz

[11] 4,314,253

[45] Feb. 2, 1982

[54] PORTABLE FOLDING MICROWAVE ANTENNA

[75] Inventor: Michael G. Sayovitz, Sunland, Calif.

[73] Assignee: Compact Video Sales, Inc., Burbank, Calif.

[21] Appl. No.: 139,258

[22] Filed: Apr. 11, 1980

[51] Int. Cl.[3] ..... H01Q 3/02; H01Q 15/20

[52] U.S. Cl. ..... 343/765; 343/915

[58] Field of Search ..... 343/840, 765, 766, 912, 343/915, 916

[56] References Cited

U.S. PATENT DOCUMENTS 3,329,960 7/1967 Winegard ..... 343/915

FOREIGN PATENT DOCUMENTS 720744 4/1942 Fed. Rep. of Germany ..... 343/915

*Primary Examiner*—Eli Lieberman

*Attorney, Agent, or Firm*—Christie, Parker & Hale

[57] ABSTRACT

A microwave directional antenna in which a parabolic reflector is mounted on a portable base. The parabolic reflector is constructed in two semicircular sections that are hinged to each other and to a supporting pedestal for rotation about a common horizontal hinge axis. The two sections can be rotated in opposite directions to move the sections between a folded position during transit and an extended position when in operation. In the extended position the two sections are locked together and rotated as a unit to change the elevation of the antenna.

7 Claims, 7 Drawing Figures

PORTABLE FOLDING MICROWAVE ANTENNA

FIELD OF THE INVENTION

This invention relates to microwave directional antennas, and more particularly, to a portable folding parabolic reflector type antenna.

BACKGROUND OF THE INVENTION

Directional microwave antennas known as dish antennas use a parabolic metal reflector for focusing the microwaves. Such antennas are used, for example, in transmitting and receiving signals between a ground communication station and a communication satellite. Such dish antennas for receiving signals from communication satellites must be of the order of 12 to 15 feet in diameter to provide an acceptable level of signal strength to the receiver. Moreover, the dish must be rigid and held to close manufacturing tolerances to prevent signal distortion. While these design limitations present no particular problem in permanent ground installations, they do present a serious problem in providing a mobile installation. Because of the size of the reflector, portability dictates that the reflector be disassembled or folded in some manner into a size which can be readily transported. This must be done without sacrificing the rigidity and dimensional accuracy of the reflector. In one known design of a portable dish antenna, removable segments on either side of the dish are provided which are small enough to be unbolted and removed by hand. These segments are located at diametrically opposite positions so that the removal of the segments in effect narrows the dish sufficiently so that it can be transported by truck. Not only do the removable segments affect the surface integrity of the reflector at the seams, but they are a problem to remove and install.

SUMMARY OF THE INVENTION

The present invention is directed to an improved design for a portable dish antenna which can be folded during transit and easily unfolded and extended for operation. The design provides a highly rigid dimensionally stable reflector. The same drive mechanism for folding the antenna can be used to change its azimuth when in operation.

These and other advantages of the present invention are achieved by providing a dish antenna comprising a base with a pedestal supported on the base. Mounted on top of the pedestal is a folding circular reflector means which is divided into first and second semicircular sections with hinge means joining the sections along a hinge axis parallel to but offset from the straight sides of the semicircular sections. The hinge means is secured to the top of the pedestal with the hinge axis extending substantially perpendicular to the vertical pedestal. Drive means rotates the semicircular sections about the hinge axis in opposite directions to move the sections between a folded position and an extended position, the sections in the folded position hanging downwardly from the hinge axis on either side of the pedestal. When in the extended position, the sections form a single circular parabolic reflector which is tiltable as a unit about the hinge axis to change the azimuth angle of the antenna.

BRIEF DESCRIPTION OF THE DRAWINGS

For a better understanding of the invention, reference should be made to the accompanying drawings, wherein.

DETAILED DESCRIPTION

Figure 1:
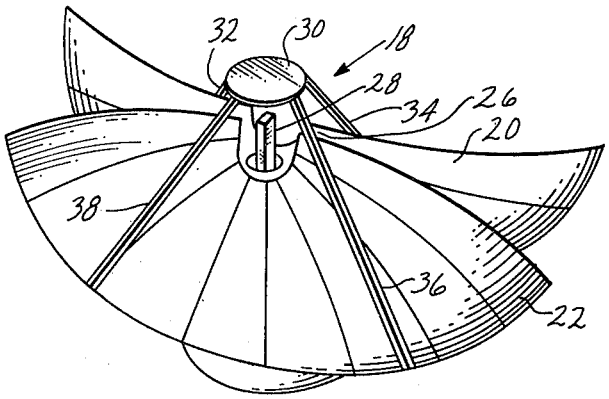
FIG. 1 is a perspective view of the antenna of the present invention with the antenna folded.

Referring to FIG. 1, the antenna structure of the present invention, indicated generally at 18, is shown in its folded condition. The main reflector dish of the antenna is divided into two semicircular sections 20 and 22 which are supported on a base 24 by a pedestal 40 and a hinge structure 26, described in detail below. A waveguide horn 28 projects out through an opening 29 at the center of the main reflector dish. A secondary reflector 30 is positioned above the horn 28 on four support arms 32, 34, 36 and 38. The arms 32 and 34 are secured at one end by a hinge connection to the rim of the reflector section 20 while the arms 36 and 38 are secured by a hinge connection to the outer rim of the dish section 22.

Figure 1A:
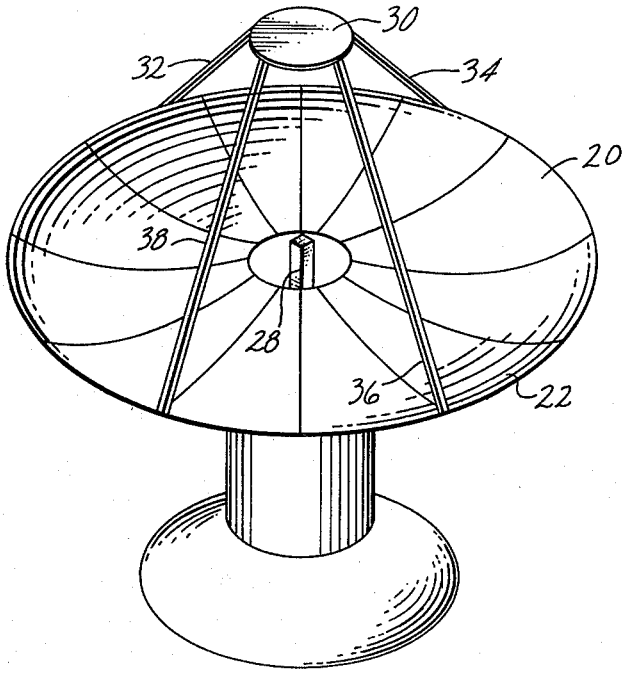
FIG. 1A is a perspective view of the antenna when extended.

When the two sections 20 and 22 of the antenna dish are rotated into an operative position as shown in FIG. 1A to form a single parabolic reflector, the secondary reflector 30 is moved away from the horn 28 by the supporting arms to the proper distance from the horn to redirect microwave energy from the horn back to the main reflector in a diverging pattern. The microwave rays are then reflected by the main reflector in substantially parallel rays for transmission to a remote satellite or other receiving station.

Referring to FIGS. 2–6 in detail, the base 24 supports a pedestal framework 40 within which is journaled a vertical shaft 42. Mounted on the top of the rotating shaft 42 is a yoke 44 including a pair of spaced upwardly projecting support arms 46 and 48. The yoke 44 provides the hinge support for the two sections 20 and 22 of the folding dish.

Figure 6:
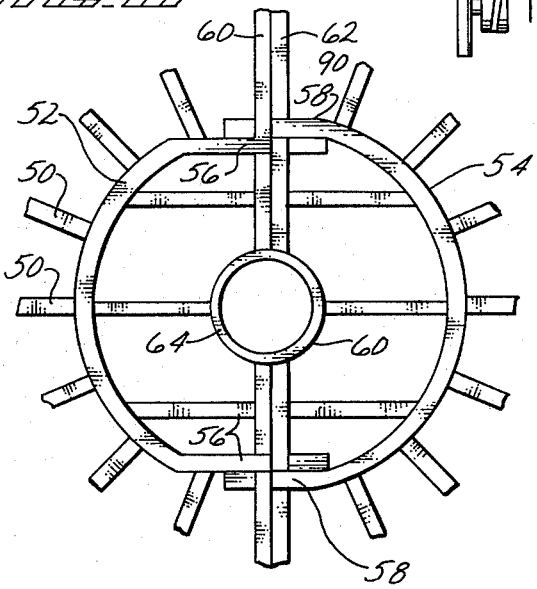
FIG. 6 is a partial top view of the extended antenna with the reflecting surface partially cut away.

Each of the folding sections of the antenna of the main reflector or dish is constructed of radial beams 50 which are welded or otherwise attached at their inner ends respectively to semicircular frame members 52 and 54. The semicircular frame members overlap at their ends to form relatively flat hinge plates, as indicated at 56,56' and 58,58', respectively. Spars 60 and 62 forming the straight sides of the two semicircular sections are secured respectively to the hinge plates 56,56' and 58,58', as shown in FIG. 6. A pair of semicircular inner frame members 61 and 63 form the central opening 29 in the main reflector through which the horn 28 projects.

Figure 2:
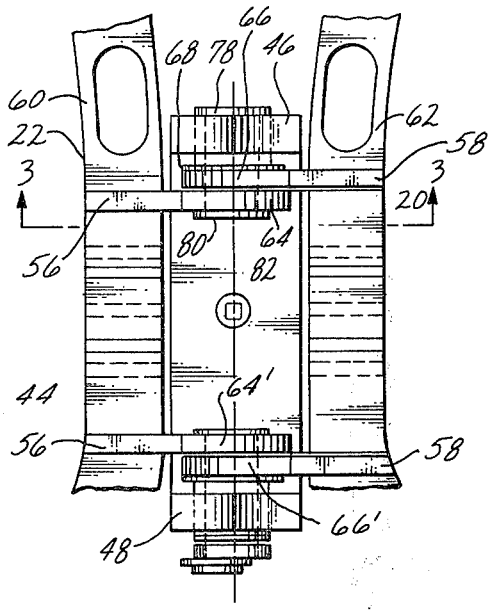
FIG. 2 is a top view of the hinge support.
Figure 3:
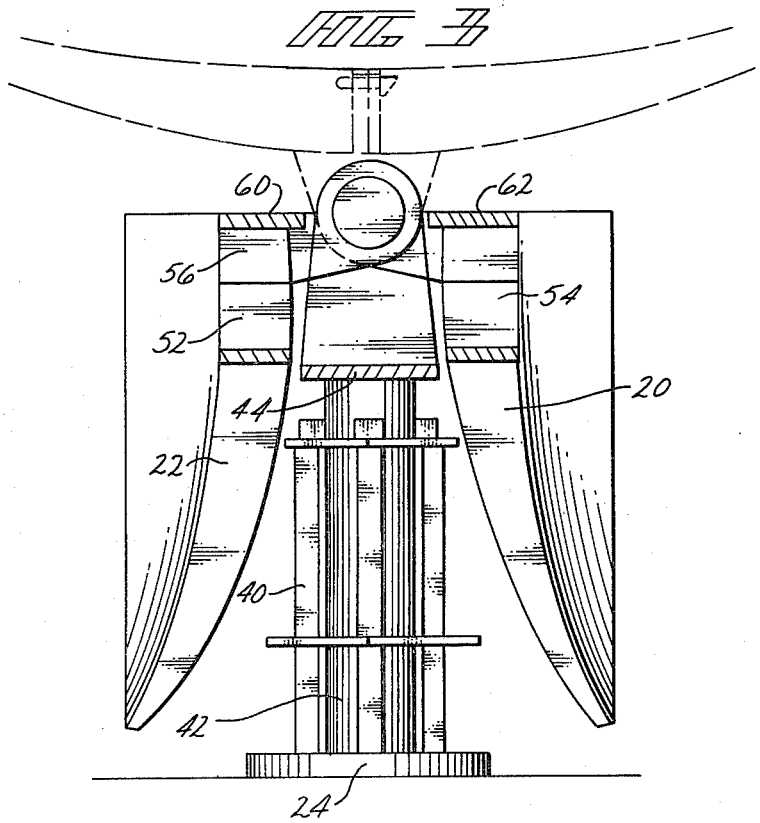
FIG. 3 is a side view partly in section of the antenna in the folded position.

As best seen in FIGS. 2 and 3, the hinge plates 56,56' and 58,58' have projecting portions 64, 64', and 66 66'. These end portions project into the space between the arms 46 and 48 of the yoke 44. A hollow cylindrical shaft 68 is journaled in the arm 46 and is suitably attached to the projecting portion 66 of the hinge plate 58. A similar hollow cylindrical shaft 68' is journaled in the other arm 48 of the yoke and is rigidly attached at one end to the end portion 66' of the hinge member 58'. Inner shafts 78, 78' are journaled in the hollow outer shafts 68, 68' so as to be coaxial therewith. The shafts 78, 78' have a flange 80 which is is bolted or otherwise secured to the end portion 64 of the hinge plate 56. The shafts 68, 68' and 78, 78' are aligned along a common hinge axis 82. In this manner the two sections 20 and 22 of the reflector are rotatably supported by the yoke 44 for rotation about the common horizontal hinge axis 82. The two sections 20 and 22 of the reflector are shown in their folded position in FIGS. 2 and 3. The projecting portions of the hinge plates provide an offset between the hinge axis and the antenna sections so that the two sections are spaced apart on either side of the pedestal 40 and yoke 44.

Figure 4:
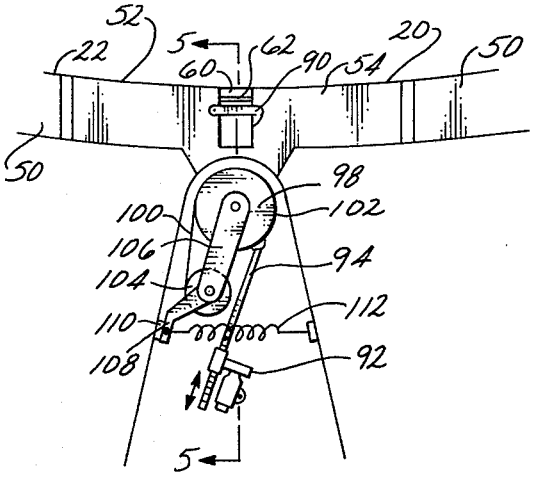
FIG. 4 is an end view partially in section showing the antenna in the extended position.
Figure 5:
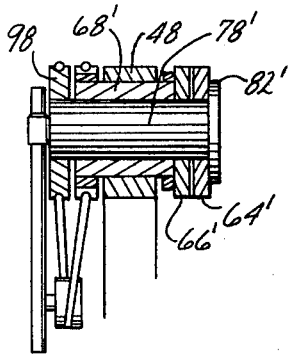
FIG. 5 is a sectional view taken substantially on the line 5—5 of FIG. 4.

Referring to FIGS. 4 and 5, the two sections 20 and 22 of the parabolic reflector are shown in the extended or operative position. The two sections are locked together by securing the spars 60 and 62 together by any suitable latching means, such as bolts, pins or the like. As shown in FIGS. 4 and 6, a set of releasable latches 90 extending through openings in the spars 60 and 62 may be used to releasably lock the spars 60 and 62 together.

A single drive mechanism is provided for both rotating the two sections of the reflector between the folded and the extended positions and for tilting the two reflector sections as a unit after they are locked together in the extended position. This is provided by a drive motor 92 which engages a screw 94 through a suitable gear drive and rotating threaded nut. The drive motor is pivotally mounted on the yoke arm 48. Rotation of the motor 92 produces displacement of the screw 94 along its axis. One end of the screw is pivotally attached to a lug 96 on a circular plate 98 rigidly attached to the projecting end of the inner shaft 78'. Thus, as the motor 92 advances the screw 94, it rotates the plate 98, shaft 78' and attached hinge member 64', thereby causing the reflector section 22 to rotate about the hinge axis 82. When the section 20 is locked to the section 22 of the reflector, the two sections are tilted as a unit about the hinge axis in response to the drive motor 92.

In order to get differential rotation of the two sections about the hinge axis to move the two sections between the folded and the extended positions, a tension band 100 is wrapped about a portion of the perimeter of the circular plate 98. The end of the band is attached to the circular plate at 102. The other end of the band extends down around an idler pulley 104 rotatably supported at the outer end of an arm 106. The arm is journaled on the end of the shaft 78'. (See FIG. 5.) After passing around the idler pulley 104, the band 100 wraps around the perimeter of the shaft 68', with the end of the band being anchored to the shaft 68'.

In operation, it will be seen that when the latches 90 are released, the weight of the two sections 20 and 22 of the reflector tends to rotate the sections in opposite directions about the hinge axis 82 under the influence of gravity. They are prevented from rotating in this manner by placing the band 100 in tension and forcing the arm 106 to rotate clockwise as seen in FIG. 4. However, the arm 106 has a projecting finger 108 which engages a stop lug 110 on the side of the supporting arm 48 of the yoke 44. As the circular plate 98 is rotated counterclockwise by the drive motor 92, the section 22 rotates counterclockwise into the folded position. As the plate 98 rotates, the band 100 is drawn around the idler pulley 104 and wrapped onto the shaft 68', allowing the shaft to rotate clockwise and thereby lowering the section 20 of the reflector into its folded position. Thus the same drive motor 92 causes differential rotation of the two sections about the hinge axis between the folded and the extended positions while providing tilting motion of the reflector as a unit when the two sections are latched together. It should be noted that in the tilting motion, there is no tension exerted on the band 100 by the section 20. It is desirable to keep some tension on the band, and to this end a spring 112 is provided which causes the arm 106 to rotate counterclockwise with the tilting of the reflector, maintaining tension on the band.

What is claimed is:

1. A portable dish antenna comprising: a base, a pedestal supported on the base, a folding circular reflector means including first and second semicircular sections having mating straight sides, mating parabolic reflecting surfaces, and hinge means joining the sections along a hinge axis parallel to the straight sides of the semicircular sections, means mounting the hinge means on top of the pedestal with the hinge axis extending substantially perpendicular to the pedestal, the hinge axis being offset from the semicircular sections by an amount slightly greater than half the width of the pedestal, means rotating the semicircular sections about the hinge axis in opposite directions to move the members between a folded position and an extended position, said sections in the folded position hanging downwardly from the hinge axis on either side of the pedestal and in the extended position forming a circular reflector, means locking the two semicircular sections together in the extended position, and means rotating the locked together sections as a unit about said hinge axis to change the elevation angle of the antenna.

2. The apparatus of claim 1 wherein the semicircular parabolic surfaces form a single parabolic reflecting surface when the members are in the extended position.

3. The apparatus of claim 2 wherein said hinge axis is offset from said reflecting surface such that said straight positions at the reflecting surface move apart as the members rotate from the extended position to the folded position.

4. The apparatus of claim 2 wherein the pedestal is rotatably supported on the base.

5. A microwave antenna comprising: a parabolic reflector having first and second sections, supporting means, hinge means joining the two sections to the supporting means for rotation relative to each other and the support means about a common hinge axis, the two sections rotating in opposite directions between a folded position and an extended position, the two sections in the extended position forming a parabolic reflecting surface, the hinge axis being substantially offset from said reflecting surface, drive means rotating the first section about said hinge axis, means linking said first section to the second section for rotating the second section in counter-rotation to the first section between the folded and extended positions, and means locking the first section to the second section when in the extended position, said drive means rotating the two sections as a unit when the sections are locked.

6. Apparatus of claim 5 wherein said hinge means includes first and second concentric shafts connected respectively to the first and second sections, said drive means being operatively connected to said first shaft.

7. Apparatus of claim 6 wherein the means linking the first and second sections includes a flexible tension member connected at one end to the first shaft and at the other end to the second shaft, an idler arm rotatably supported on said hinge axis, an idler pulley supported on said arm at a point radially spaced from said hinge axis, the tension member extending around said pulley, and stop means engaging the arm to limit rotation of the arm in response to tension in said member, counter-rotation of the shafts producing tension in said tension member.

* * * * *